US006530400B2

(12) United States Patent
Nelson

(10) Patent No.: US 6,530,400 B2
(45) Date of Patent: Mar. 11, 2003

(54) INTERMEDIATE PRESSURE DISPENSING METHOD FOR A CARBONATED BEVERAGE

(75) Inventor: Patrick L. Nelson, Sun Prairie, WI (US)

(73) Assignee: Dispensing Systems International, Inc., Madison, WI (US)

( * ) Notice: Subject to any disclaimer, the term of this patent is extended or adjusted under 35 U.S.C. 154(b) by 0 days.

(21) Appl. No.: 10/067,524

(22) Filed: Feb. 5, 2002

(65) Prior Publication Data

US 2002/0112776 A1 Aug. 22, 2002

Related U.S. Application Data

(60) Provisional application No. 60/269,830, filed on Feb. 20, 2001.

(51) Int. Cl.[7] ..... B65B 1/04

(52) U.S. Cl. ..... 141/2; 141/263; 141/192; 141/18; 141/356; 222/146.6

(58) Field of Search ..... 141/263, 264, 141/253–255, 267, 270, 275–278, 351, 356, 369, 374, 94, 95, 192, 198, 98, 2, 67, 18; 222/146.6

(56) References Cited

U.S. PATENT DOCUMENTS

| | | | |
|---|---|---|---|
| 3,876,107 | A | 4/1975 | Meindl et al. |
| 3,881,636 | A | 5/1975 | D'Aubreby |
| 3,978,900 | A | 9/1976 | Mencacci et al. |
| 4,560,089 | A | 12/1985 | McMillin et al. |
| 5,566,732 | A | 10/1996 | Nelson |
| 5,603,363 | A | 2/1997 | Nelson |
| 6,237,652 | B1 | 5/2001 | Nelson |

FOREIGN PATENT DOCUMENTS

| | | | |
|---|---|---|---|
| DE | 3435725 | A1 | 4/1985 |
| EP | 0 861 801 | A1 | 2/1998 |

*Primary Examiner*—Steven O. Douglas
(74) *Attorney, Agent, or Firm*—George E. Haas; Quarles & Brady LLP

(57) ABSTRACT

A carbonated beverage is conveyed from a source to a closed reservoir at a first pressure level. The pressure in the reservoir is controlled by selectively venting gas and adding pressurized gas to the reservoir to maintain the carbonated beverage at a second pressure level that is less than the first pressure level and substantially greater than atmospheric pressure. The carbonated beverage is dispensed from the reservoir into a serving container by reducing the pressure in the reservoir to substantially atmospheric pressure and then opening an outlet valve. During prolonged periods when dispensing is not occurring, the pressure in the reservoir may be increased to prevent degassing of the carbonated beverage. In that case, the reservoir pressure is reduced to the second pressure level before another dispensing operation.

34 Claims, 2 Drawing Sheets

INTERMEDIATE PRESSURE DISPENSING METHOD FOR A CARBONATED BEVERAGE

CROSS-REFERENCE TO RELATED APPLICATIONS

This application claims benefit of U.S. Provisional Patent Application No. 60/269,830 filed Feb. 20. 2001.

STATEMENT REGARDING FEDERALLY SPONSORED RESEARCH OR DEVELOPMENT

Not Applicable

BACKGROUND OF THE INVENTION

1. Field of the Invention

The present invention relates to equipment for dispensing a carbonated beverage into an open container from which the beverage will be consumed; and more particularly to such equipment in which the dispensing occurs in a manner that minimizes foaming of the beverage.

2. Description of the Related Art

It is common for carbonated beverages, such as soda and beer, to be supplied in a sealed canister or keg which then is connected to a tap at an establishment, such as one that serves food. As used herein the term "establishment" refers to a business or a residence. Pressurized gas, such as carbon dioxide, is injected into the keg to force the liquid beverage through an outlet tube to the tap from which it is dispensed into various sizes Of cups, mugs and pitchers.

The carbonated beverage usually foams upon entering the serving container. As a consequence, personnel operating the tap typically fill the serving container until the level of foam reaches the brim and then wait for the foam to settle before adding additional beverage. In some instances several iterations of this process are required before the container is filled with liquid to the proper serving level. Such "topping off" necessitated by the foaming of the beverage prolongs the dispensing operation and impedes the ability to fully automate carbonated beverage dispensing.

Automated dispensing is particularly useful in large volume carbonated beverage operations, such as sports arenas and stadiums, where it is desirable to fill each container to the full serving level as fast as possible with minimal waste.

U.S. Pat. No. 5,603,363 describes a dispensing system that satisfies that desire. The carbonated beverage is fed into an elevated tank that is open to the atmosphere so that the beverage stored therein is at atmospheric pressure at all times. A spout is located beneath the tank and has a valve through which the beverage flows into a serving container. Selective operation of the valve and movement of the serving container enable rapid dispensing with minimal foaming. A drawback of this system is that the tank is open to the atmosphere. Thus the beverage tends to degas upon prolonged storage in the tank. In addition, there is a concern that bacteria and other substances may enter the open tank and contaminate the beverage therein, especially between hours of operation of the beveratte establishment.

Alternative systems, such as described in U.S. Pat. No. 3,881,636, employs a closed tank with a vent tube at the top of the tank that provides a restricted passage to the atmosphere. The beverage is fed to the tank under the same pressure as in the keg and is maintained substantially at that elevated pressure until a spout is opened to fill a glass. At that time the tank pressure is reduced to the atmospheric level before the valve on the spout is opened. Upon completion of the dispensing operation the tank is brought back to the keg pressure. In a high volume dispensing establishment, this latter type of dispensing system has the disadvantage that time is lost while the reservoir is brought down to atmospheric pressure before the spout is opened. A further delay results from having to raise the tank to the keg pressure in order replenish the beverage in the tank. Thus it is desirable to increase the speed of dispensing further.

SUMMARY OF THE INVENTION

A method for dispensing a carbonated beverage conveys the beverage from a source into a closed reservoir at first pressure level that is greater than atmospheric pressure. In the case of beer, this first pressure typically is the internal pressure of the beer keg as shipped from the brewery, which pressure is known as the "rack pressure." The carbonated beverage then is dispensed from the reservoir into an open container.

While being held in the reservoir, the carbonated beverage is maintained at a second pressure level that is less than the first pressure level and substantially greater than atmospheric pressure. This second pressure level is referred to as the "holding pressure." Preferably the second pressure level is at least one psi, and five psi has been found particularly desirable for holding beer at reduced temperatures to minimize degassing. When it is desired to dispense the carbonated beverage into a serving container, the reservoir pressure is reduced to substantially atmospheric pressure. With the reservoir at substantially atmospheric pressure, the carbonated beverage flows into the container with minimal foaming as the beverage is exposed to a relatively small pressure differential.

Another aspect of the dispensing system. relates to opening a valve through which the carbonated beverage flows from the reservoir into the serving container. The valve is opened while the fluid inlets to the reservoir are closed, thereby preventing any additional beverage from entering the reservoir. With the inlets closed, the weight of the carbonated beverage in the spout causes the pressure in the reservoir to decrease below atmospheric pressure, thereby minimizing the flow of beverage into the container as the valve opens. After that valve has opened to a point at which the risk of foaming is negligible, a fluid, such as carbon dioxide for example, is introduced to raise the pressure in the reservoir to substantially the atmospheric pressure or greater. It has been found that increasing the reservoir pressure after the valve opens can improve the dispensing rate or enhance the presentation of the beverage being poured. At the end of the dispensing operation, pressure in the reservoir is allowed to decrease below atmospheric pressure to reduce flow of the carbonated beverage from the reservoir before the valve is closed.

In the preferred operation of the dispensing system, the pressure of the reservoir is raised to the first pressure level during prolonged periods of inactivity, such as when the food service establishment is closed. That higher pressure level enables the carbonated beverage to be stored for such a prolonged time without degassing. The reservoir pressure then is reduced to the second pressure level upon commencement of another dispensing operation.

DETAILED DESCRIPTION OF THE INVENTION

Figure 1:
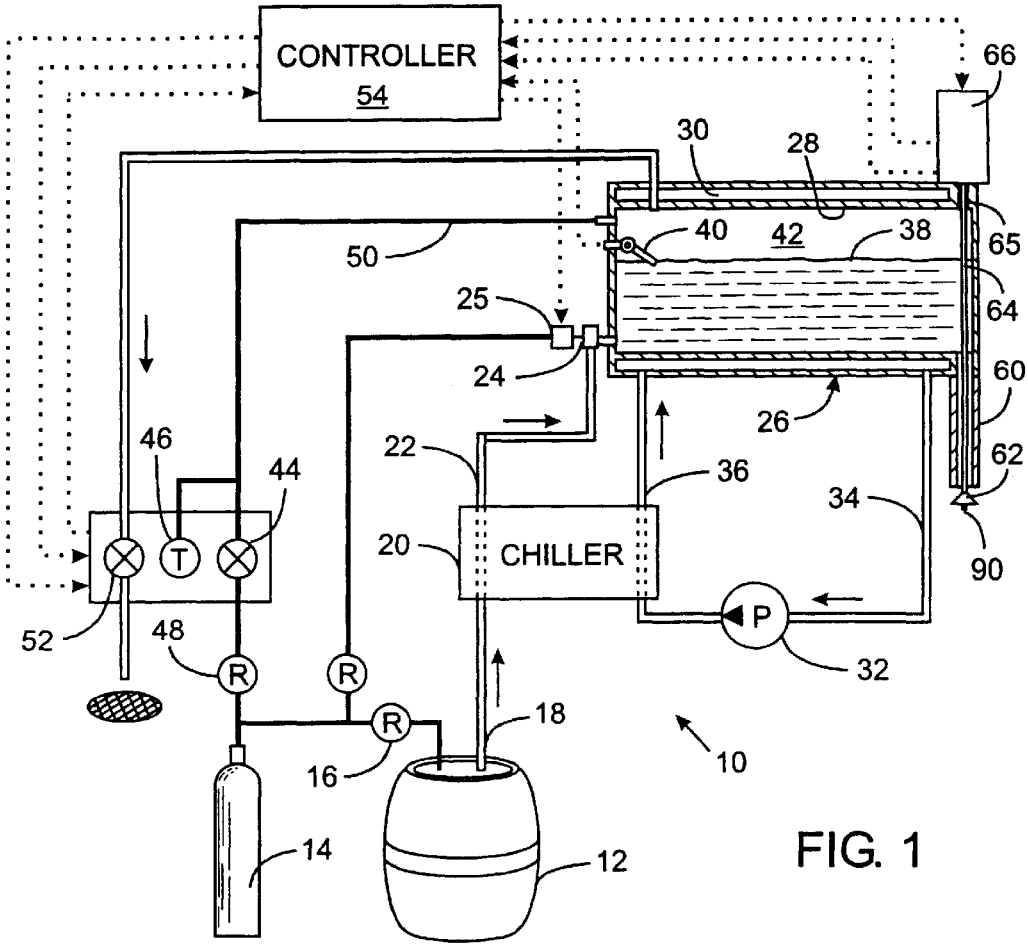
FIG. 1 is a schematic diagram of a beverage dispensing system according to the present invention.

With initial reference to FIG. 1, a beverage dispensing system 10 receives a fully mixed carbonated beverage, such as beer or soda from a keg 12. A source of pressurized gas, for example a cylinder 14 of carbon dioxide, is connected by a pressure regulator 16 to an inlet of the keg 12. The pressure regulator 16 maintains the internal pressure of the keg at a first level recommended by the brewer of the beer. A pressure of 15 psi is commonly used for many beers. It should be understood that this pressure may deviate ±2 psi and still be considered substantially at the recommended first pressure level. Alternatively, a compressor can apply pressurized air to the keg, or a pump system can be used to transport the beverage from the keg 12 to the beverage dispensing system 10. The keg pressure is commonly referred to as the "rack" pressure, and may be applied to several kegs within the establishment at which the beverages are being served.

The application of pressure to the keg 12 forces the beverage from an outlet through a dispensing line 18. The beverage line 18 passes through an internal coil of a chiller 20 which lowers the temperature of the beverage to a desired dispensing temperature. Although many establishments, store the keg 12 in a walk-in refrigeration unit, that may not be the case for a high volume establishment. Also when a keg is exhausted, a replacement may be obtained from an unrefrigerated area. After being chilled, the beverage flows through line 22 to an inlet valve 24 of a beverage reservoir 26. The inlet valve 24 is operated by a gas driven actuator 25 in response to an electric signal. Alternatively, an electric solenoid operated inlet valve can be used.

The reservoir 26 has a closed inner chamber 28 into which the beverage flows when the inlet valve 24 is opened. A jacket of the reservoir 26 forms an outer cavity 30 which extends around the inner chamber 28. Chilled water is circulated through this outer cavity to maintain the contents of the inner chamber at the proper temperature. Specifically, a pump 32 draws water from the outer cavity 30 via an outlet line 34 and forces the water through a separate coil within the chiller 20. This chills the water to the desired temperature and the chilled water then is returned through an inlet line 36 to the outer cavity 30 of the reservoir 26. Baffles may be provided within the outer cavity 30 to ensure that the chilled water flows completely around the inner chamber 28 to maintain the beverage 38 therein at a relatively uniform temperature.

The beverage 38 partially fills the inner chamber 28 to a height that is detected by a level sensor 40. The upper portion 42 of the closed inner chamber 28 is filled with gas, the pressure of which is sensed by a pressure transducer 46 in gas supply line 50. Alternatively the pressure transducer can be mounted directly in the reservoir chamber 28. When pressure in the inner chamber 28 needs to be increased, as will be described, a gas supply valve 44 is opened to convey carbon dioxide from tank 14 through a second pressure regulator 48 and gas supply line 50 to the upper portion 42 of the inner chamber. If the pressure within the inner chamber 28 is too great, a relief valve 52 is opened to vent that excess pressure to the ambient environment. Thus the fact that the beverage is held in a closed inner chamber 28 means that the beverage is maintained above atmospheric pressure at a level determined by operation of the gas supply valve 44 and the relief valve 52. The valves 44 and 52 are electrically operated by signals from a controller 54, in response to the signal from pressure transducer 46.

During extended, repeated dispensing operations excess beverage foam may accumulate in the inner chamber 28. Foam accumulation also may occur when a "mishandled" or "wild" keg 12 of the beverage is connected to the system. When foam occurs, it must be vented to the ambient environment. This processing of foam is required so that the level switch 40 does not responds to the presence of the foam which has a lower density relative to the liquid beverage. Consequently, as the reservoir 26 is replenished with liquid beverage 38 through inlet valve 24, the excess foam is forced from the inner chamber 28 through the relief valve 52.

The reservoir 26 includes a dispensing spout 60 extending downwardly therefrom. The flow of beverage through the spout 60 is controlled by a movable valve element 62 that is mounted at the lower end of a tube which extends vertically through the spout 60 and the reservoir 26. An upper end of the tube 64 passes through a seal 65 and is connected to an actuator 66, which raises and lowers the tube. That motion brings the valve element 62 into and out of engagement with the spout to allow beverage to flow into a container placed there beneath. The actuator 66 is operated by signals from the controller 54, as will be described.

Figure 2:
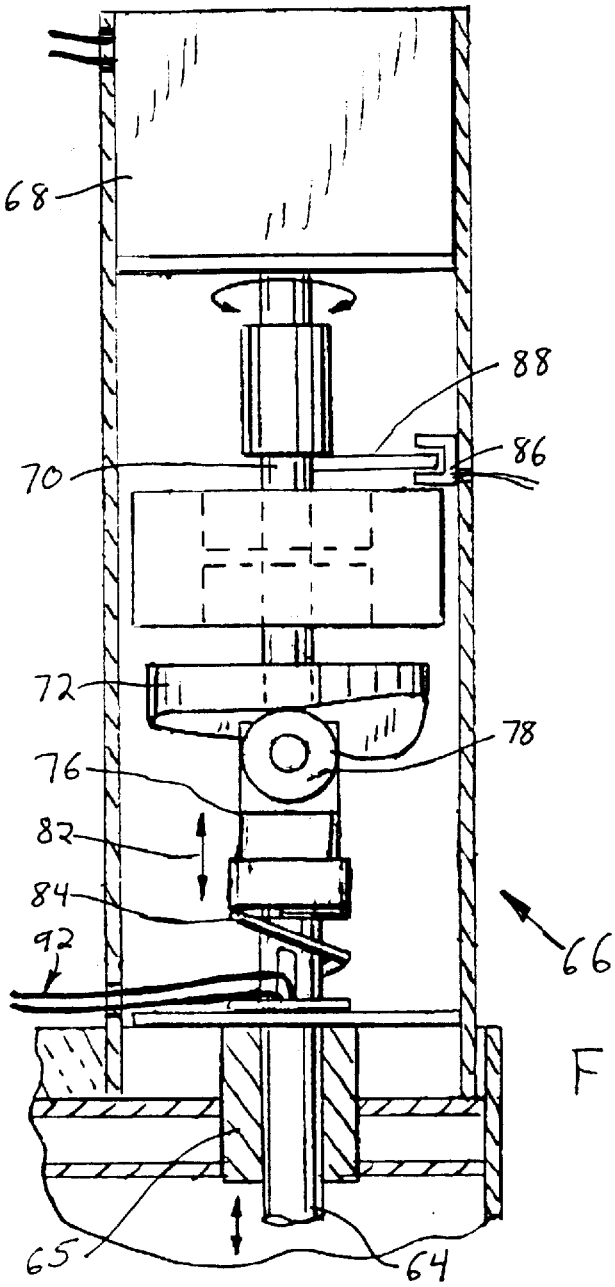
FIGS. 2 and 3 illustrate a cam mechanism which drives a valve of the beverage dispensing system.
Figure 3:
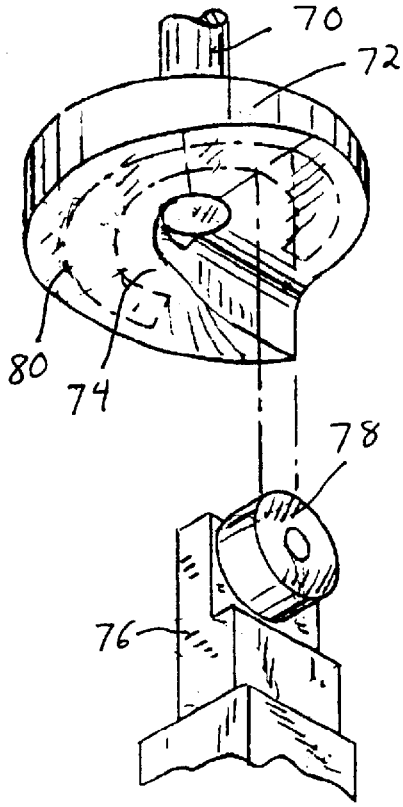

Referring to FIG. 2, the actuator 66 has bidirectional stepper motor 68 which rotates a shaft 70. A cam disk 72 is attached to the remote end of shaft 70. As shown in FIG. 3, the lower surface of the cam disk 72 forms a curved ramp 74. A cam follower 76 has a wheel 78 which rides along a curved path, designated by broken lines 80, on the bottom surface of the cam disk 72. Thus, as the cam disk 72 is rotated clockwise or counter clockwise by stepper motor 68, the cam ramp 74 forces the cam follower 76 up and down, as indicated by arrow 82 in FIG. 2. This action causes the tube 64, that is attached to the cam follower 76, to move the valve element 62 against and away from the end of the spout 60, thereby controlling the flow of beverage out of the spout.

A straight blade 88 extends from the shaft 70 and interrupts a light beam in an optical sensor 86 when the motor has rotated to the zero degree, or "home", position at which the spout valve is closed. The controller 54 uses the signal provided by the optical sensor 86 and the positioning capability of the stepper motor 68 to accurately control the position of the spout valve element. Alternatively, a stepper motor that provides linear thrust along its shall, such as provided by a drive screw, could be used to provide the linear motion to drive the spout valve element, thereby eliminating the need for the cam disk 72 and follower 76. This latter drive mechanism requires a different configuration of the optical sensor to detect the home position.

With reference to FIG. 1, a switch 90 is mounted on the valve element 62 and is depressed by the bottom of a beverage container placed underneath the spout 60. The switch 90 is connected by a pair of wires 92 which run through the tube 64 emerging within the actuator 66 as shown in FIG. 2. These wires connect to an input of the controller 54.

The beverage is supplied to the reservoir 26 from the keg at a first pressure level that corresponds to the rack pressure of the keg. The pressure within inner chamber 28 of the reservoir 26 is maintained at a second pressure level that is referred to as the "holding pressure." The second pressure level is greater than one psi and a level of at least five psi has been found particularly desirable for beer. Because the holding pressure is substantially above atmospheric pressure, at least one psi, and because the beverage in the reservoir is held at a relatively low temperature (e.g. less than 35° F.), degassing of the beverage is minimized during the relatively brief period of time that the beverage remains in the reservoir.

When a server desires to dispense the beverage, an open serving container is placed beneath the spout 60 and moved upward until the bottom of the container presses the switch 90 on the valve element 62. This transmits a signal to the controller 54 indicating that a beverage dispensing operation should commence. If beverage is dispensed through the spout 60 at the holding pressure, turbulence will occur producing excessive foam in the beverage container which is an undesirable effect. As a consequence with reference to FIG. 5. when the controller 54 initiates a pour cycle at time T1. the pressure relief valve 52 in FIG. 1 is opened to vent the pressure within the inner chamber 28 to the outside environment. The pressure is decreased from the holding pressure P2 to a dispensing pressure P3 which is substantially at atmospheric pressure. It will be recognized that the precise atmospheric pressure fluctuates with meteorological changes. The objective is to reduce the pressure to a point at which minimal foaming occurs in the container as is achieved when the pressure in the reservoir equals that of the container. A slight pressure difference, ±1 psi for example, can exist without producing an excessive amount of foam which would deprive the customer of a full serving of the beverage.

Figure 4:
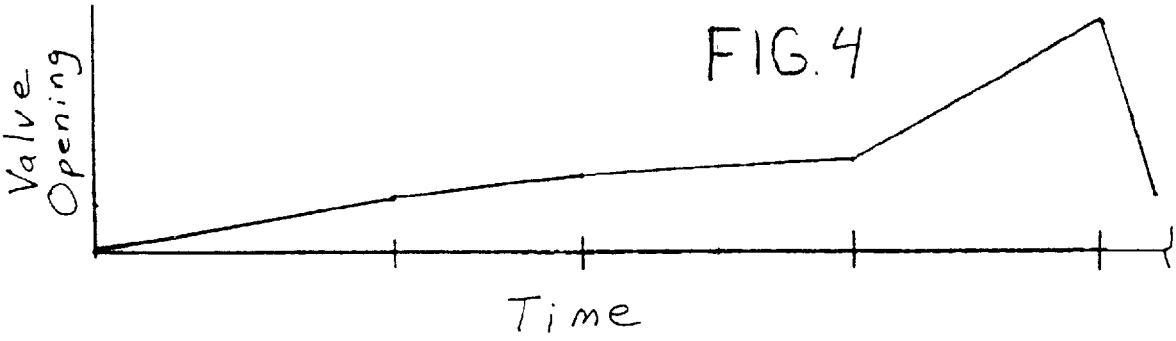
FIG. 4 is a graph relating the opening distance of a valve in the beverage dispensing system to time.

When at time T2 the pressure has reached the dispensing pressure P3, as indicated by the signal from pressure transducer 46, the controller 54 activates the stepper motor 68 of the actuator 66, which causes the valve element 62 to move away from the end of the spout 60. This opens a passage for fluid to flow from the spout 60 into the serving container held there beneath. FIG. 4 illustrates an exemplary movement of the valve member 62 during the dispensing interval, and thus the degree to which the valve is opened. The contour of pour provided by this movement of the valve member 62 is defined by characteristics of the beverage, the temperature of the beverage, and the pressure at which the pour is occurring. The shape of the contour can be varied by control of the stepper motor 68 to minimize the foam generation during the dispensing operation.

In prior systems, when the valve element cracks open, the beverage tends to flow through the initial small opening at a relatively high velocity which produces turbulence and thus foam in the serving container. This adverse effect is prevented by creating a negative pressure in the spout which restricts the beverage flow until the valve has opened to a point at which foaming will not occur. Specifically as the spout 60 opens, the gas supply valve 44 remains closed thus creating a slight vacuum due to the weight of the beverage in the reservoir. This limits the flow of beverage from the spout 60 to a very small quantity, which is particularly important for extremely carbonated beverages which foam easily. After the valve element 62 has opened significantly at time T3, the gas supply valve 44 is activated by controller 54 to introduce pressurized gas from source 14 into the reservoir and increase the pressure to the dispensing pressure P3. The rate at which the pressure is increased between times T3 and T4 regulates the velocity at which the beverage leaves the reservoir and thus can be configured according to the level of carbonation of the particular beverage.

The product continues to flow out of spout 60 between times T4 and T5 while pressure in the reservoir is maintained at the dispensing level P3. Alternatively, as shown by the dashed line 96 in FIG. 5, the controller 54 can operate the gas supply valve 44 and relief valve 52 to increase and decrease the pressure being applied to reservoir inner chamber 28. Such pressure fluctuations are less than ±1 psi from atmospheric pressure. Dispensing at a greater deviation from atmospheric pressure requires careful control to avoid excessive foaming as the beverage is dispensed into the serving container. However, pressure fluctuations may be three psi or greater for heavy beers that are typically aerated when dispensed to produce a thick creamy head. Such is the case with Irish stout ales and seasonal dark beers. This increased pressure is needed to provide sufficient turbulence which produces the desired presentation of the beverage in the serving container, i.e. the desired foam head.

Because the pressure in the reservoir 26 is held to the controlled level P3 during the dispensing cycle, the beverage flows from the spout at a controlled rate. At a sports venue, the serving containers for a given kind of beverage typically are the same size. As a consequence, the portion size is controlled by holding the spout open for a fixed period of time required to dispense the proper quantity of beverage. It should be noted that even if pressure level P3 is varied during the dispensing cycle, the pressure variation and duration of the change are accurately controlled to allow the desired portion size to be repeatedly dispensed. When the controller 54 determines that the dispensing interval T1 to T5 has elapsed, the gas supply valve 44 is shut off while the conical valve element 62 remains open, thus creating a slight vacuum in the reservoir. The flow of the beverage through the spout 60 immediately slows dramatically due to the negative pressure. The beverage dispensing has essentially stopped without closing the spout valve, which, for a carbonated beverage, may be a very beneficial technique as turbulence due to movement of the valve element 62 is eliminated. Then at time T6, the stepper motor 68 is activated in the opposite direction, thereby closing the valve element 62 against the open end of the spout 60 and terminating the flow of beverage through the spout at time T7.

As beverage flows out of the spout 60 into the serving container, the level of beverage 38 within the reservoir's inner chamber 28 decreases which is detected by the level sensor 40. The beverage can be replenished either during the dispensing operation or thereafter. Replenishing the beverage during dispensing permits the beverage flow into the reservoir to be used to control the reservoir pressure instead of or in addition to regulating the introduction of carbon dioxide from the tank 14. In this case, the controller 54 responds to the signal from the level sensor 40 by opening the beverage supply valve 24, thereby enabling cooled beverage from the chiller 20 to flow into the bottom of the inner chamber 28. The rate at which additional beverage flows into the inner chamber 28 is independent of the flow rate through the spout 60. In fact, in a preferred embodiment, the beverage flows through the spout 60 at a faster rate than the rate at which beverage enters the reservoir. As a consequence, the dispensing operation usually terminates before the beverage 38 within the inner chamber 28 has been replenished to the desired level. Regardless, the valve 24 remains open until the level sensor 40 indicates that the proper quantity of beverage is stored within the reservoir's inner chamber 28.

While the beverage is entering the reservoir inner chamber 28, the controller 54 monitors the inner chamber pressure via the signal from transducer 46. Should the pressure of the inner chamber 28 deviate from the desired level, the controller 54 operates the relief valve 52 to lower the pressure or operates gas supply valve 44 to increase the pressure with additional carbon dioxide gas from cylinder 14. Thus the reservoir pressure is maintained for proper dispensing.

After the dispensing operation terminates at time T7, the pressure within the inner chamber 28 is raised to the holding pressure P2 to be ready for another dispensing operation. The reservoir pressure is increased by the controller 54 maintaining the pressure relief valve 52 closed and opening gas supply valve 44 to apply pressure regulated carbon dioxide from supply tank 14 to the upper region 42 of the reservoir's inner chamber 28. While this occurs, the pressure within that inner chamber is monitored via a signal from pressure transducer 46. Once the inner chamber has again reached the holding pressure P2 at time T8, the gas supply valve 44 is closed. Thereafter, the controller 54 periodically checks the inner chamber pressure and operates valves 44 and 52 as necessary to maintain the holding pressure P2. By maintaining the beverage in the reservoir at the intermediate holding pressure that is between the rack and atmospheric pressure and at a reduced temperature, the amount of degassing that would occur at atmospheric pressure is reduced and upon commencement of dispensing the reservoir pressure does not have to decrease as much as it would if maintained at the rack pressure P1. Thus degassing is reduced while the beverage flow begins quickly when a dispensing operation commences.

Figure 5:
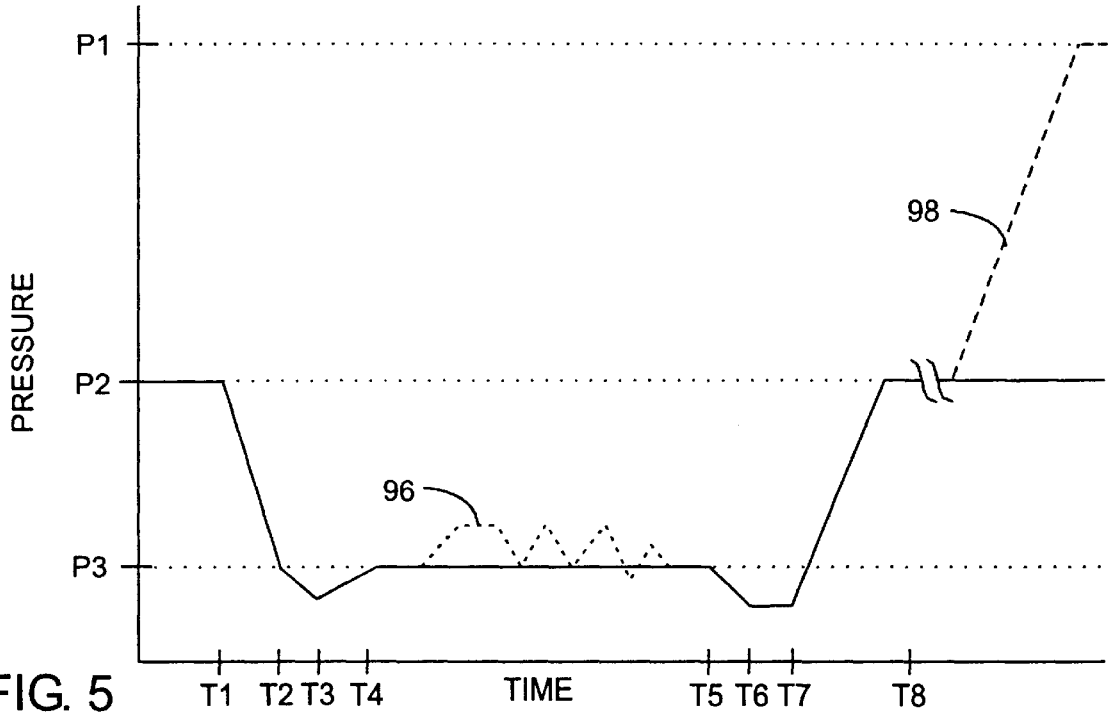
FIG. 5 is a graph of the pressure in a reservoir while beverage is being dispensed into a container.

When the beverage establishment closes, such as at the end of the business day, the reservoir 26 is brought up to the rack pressure P1 as shown by the dashed line 98 in FIG. 5. This will maintain the beverage stored in the reservoir at a pressure where minimal degassing occurs. The inner chamber pressure is lowered again to the holding pressure P2 when the establishment reopens or at the commencement of the next dispensing operation. In instances where a relatively long time period (e.g. ten minutes) elapses after a previous dispensing operation, the reservoir pressure can be increased to the rack pressure P1 to further limit the degassing.

The present beverage dispensing system employs a closed reservoir that prevents contaminants from adversely effecting the beverage being stored in the dispenser. At the same time, the pressure of the beverage is regulated so that it is stored at a relatively high pressure that prevents gas from escaping the beverage, and yet the pressure to a low level for proper pouring into a beverage container with foaming.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

I claim:

1. A method for operating a system to dispense a carbonated beverage into a serving container at an establishment, that method comprising:

connecting the system to a source which supplies the carbonated beverage at a first pressure level that is greater than atmospheric pressure;

maintaining a reservoir of the system at a second pressure level that is less than the first pressure level and substantially greater than atmospheric pressure;

transferring the carbonated beverage from the source to the reservoir that is maintained at the second pressure level;

when dispensing the carbonated beverage into the serving container is desired, lowering pressure in the reservoir to substantially the atmospheric pressure; and dispensing the carbonated beverage from the reservoir into the serving container, after pressure in the reservoir is at substantially the atmospheric pressure.

2. The method as recited in claim 1 wherein the second pressure level is greater than one psi.

3. The method as recited in claim 1 wherein the second pressure level is substantially five psi.

4. The method as recited in claim 1 wherein maintaining the carbonated beverage in the reservoir at a second pressure level comprises applying pressurized gas to the reservoir to increase pressure of the carbonated beverage, and venting gas from the reservoir to decrease pressure of the carbonated beverage.

5. The method as recited in claim 1 wherein maintaining the carbonated beverage in the reservoir at a second pressure level further comprises transferring the carbonated beverage to the reservoir from the source during the dispensing.

6. The method recited in claim 1 further comprising maintaining the carbonated beverage in the reservoir at substantially the first pressure level when the establishment is closed for business.

7. The method recited in claim 1 further comprising raising pressure of the carbonated beverage in the reservoir to substantially the first pressure level when at least ten minutes has elapsed since a prior dispensing of the beverage.

8. The method recited in claim 1 further comprising monitoring how much carbonated beverage is contained in the reservoir; and wherein the transferring occurs in response to the monitoring to maintain a predefined quantity of beverage in the reservoir.

9. The method recited in claim 1 further comprising circulating a chilled fluid around an exterior surface of a chamber of the reservoir which chamber contains the carbonated beverage.

10. The method recited in claim 1 wherein the dispensing comprises:

opening a first passageway through which the carbonated beverage flows from the reservoir into the serving container;

allowing pressure in the reservoir to go below atmospheric pressure; and thereafter opening a second passageway to introduce a fluid into the reservoir to raise the pressure in the reservoir to substantially atmospheric pressure.

11. The method recited in claim 10 wherein the fluid is selected from a group consisting of the beverage and a gas.

12. The method recited in claim 10 wherein the dispensing further comprises varying pressure in the reservoir while the carbonated beverage flows from the reservoir to control an amount of foaming of the carbonated beverage in the serving container.

13. The method recited in claim 1 wherein the dispensing comprises:

allowing pressure in the reservoir to go below atmospheric pressure to reduce flow of the carbonated beverage from the reservoir; and thereafter closing a passageway through which the carbonated beverage flows from the reservoir into the serving container.

14. The method recited in claim 13 further comprising, after closing the passageway, raising pressure in the reservoir to the second pressure level.

15. A method for dispensing a carbonated beverage into a serving container, that method comprising:

transferring the carbonated beverage to a reservoir from a source, which supplies the carbonated beverage at a first pressure level that is greater than atmospheric pressure;

sensing pressure in the reservoir;

in response to the sensing, maintaining the carbonated beverage in the reservoir at a second pressure level that is less than the first pressure level and substantially greater than atmospheric pressure by selectively operating a relief valve to decrease pressure in the reservoir and by selectively operating a supply valve to add pressurized fluid to increase the pressure in the reservoir;

when dispensing the carbonated beverage into the serving container is desired, lowering pressure in the reservoir to a third pressure level that is less than the second pressure level; and dispensing the carbonated beverage by operating a valve element to open a passageway from the reservoir to the serving container while the beverage is maintained in the reservoir substantially at the third pressure level.

16. The method as recited in claim 15 wherein the third pressure level is substantially atmospheric pressure.

17. The method as recited in claim 15 wherein the pressurized fluid is a gas.

18. The method as recited in claim 15 wherein the pressurized fluid is the carbonated beverage.

19. The method as recited in claim 15 wherein the first pressure level is substantially 15 psi.

20. The method as recited in claim 15 wherein the second pressure level is greater than one psi.

21. The method as recited in claim 15 wherein the second pressure level between one and five psi, inclusive.

22. The method recited in claim 15 further comprising increasing the pressure of the carbonated beverage in the reservoir to the first pressure level when dispensing does not occur for a predefined period of time; and thereafter reducing the pressure of the carbonated beverage in the reservoir to the second pressure level prior to operating the valve element.

23. The method recited in claim 15 further comprising monitoring how much carbonated beverage is contained in the reservoir; and wherein the transferring is in response to the monitoring to maintain a predefined quantity of beverage in the reservoir.

24. The method recited in claim 15 further comprising circulating a chilled fluid around an exterior surface of a chamber of the reservoir that contains the carbonated beverage.

25. The method recited in claim 15 wherein the dispensing comprises:

maintaining the relief valve and the supply valve closed;

opening the valve element so that pressure in the reservoir goes below atmospheric pressure; and at a predefined time after opening the valve element, opening the supply valve to raise the pressure in the reservoir to the third pressure level.

26. The method recited in claim 15 wherein the dispensing comprises:

reducing flow of the carbonated beverage from the reservoir by allowing pressure in the reservoir to go below atmospheric pressure; and thereafter closing the valve clement through which the carbonated beverage flows from the reservoir into the serving container.

27. The method recited in claim 26 further comprising, after closing the valve raising pressure in the reservoir to the second pressure level.

28. A method for dispensing a carbonated beverage into a serving container from a reservoir that contains a quantity of beverage and a volume of gas, that method comprising:

transporting the carbonated beverage from a source to the reservoir at a first pressure level that is greater than atmospheric pressure;

maintaining pressure within the reservoir at a second pressure level, that is less than the first pressure level and substantially greater than atmospheric pressure, by selectively venting gas from the reservoir and adding pressurized gas to the reservoir;

when dispensing the carbonated beverage into the serving container is desired, lowering pressure in the reservoir to substantially the atmospheric pressure;

when pressure in the reservoir is substantially the atmospheric pressure, opening a valve through which the carbonated beverage flows from the reservoir into the serving container;

as the valve opens, allowing pressure in the reservoir to go below atmospheric pressure; and at a predefined time after opening the valve, introducing a fluid into the reservoir to raise the pressure in the reservoir to substantially atmospheric pressure.

29. The method as recited in claim 28 wherein the second pressure level is greater than one psi.

30. The method recited in claim 28 further comprising sensing a level of carbonated beverage in the reservoir; and wherein the conveying is in response to the sensing to maintain a predefined quantity of beverage in the reservoir.

31. The method recited in claim 28 which further comprises terminating flow of the carbonated beverage into the serving container by:

reducing flow of the carbonated beverage from the reservoir by allowing pressure in the reservoir to go below atmospheric pressure; and thereafter closing the valve through which the carbonated beverage flows from the reservoir into the serving container.

32. A method for dispensing a carbonated beverage into a serving container at an establishment, that method comprising:

storing the carbonated beverage in a reservoir at a given pressure level;

opening a valve through which the carbonated beverage flows from the reservoir into the serving container;

allowing pressure in the reservoir to go below atmospheric pressure; and thereafter introducing a fluid into the reservoir to raise the pressure in the reservoir to substantially atmospheric pressure.

33. The method recited in claim 32 wherein the given pressure level is substantially greater than atmospheric pressure; and further comprising reducing pressure in the reservoir to substantially atmospheric pressure before opening the valve.

34. The method recited in claim 32 which further comprises terminating flow of the carbonated beverage into the serving container by:

allowing pressure in the reservoir to go below atmospheric pressure to reduce flow of the carbonated beverage from the reservoir; and thereafter closing the valve.

* * * * *